US006129268A

United States Patent [19]

Stahlecker

[11] Patent Number: 6,129,268

[45] Date of Patent: Oct. 10, 2000

[54] CONTAINER COMPRISING A CONTAINER BODY PART AND A FRONT WALL CONNECTED THERETO

[75] Inventor: Werner Stahlecker, Stuttgart, Germany

[73] Assignee: Ruediger Haaga GmbH, Germany

[21] Appl. No.: 08/838,912

[22] Filed: Apr. 11, 1997

Related U.S. Application Data

[63] Continuation of application No. 08/545,094, Oct. 19, 1995, abandoned.

[30] Foreign Application Priority Data

Nov. 15, 1994 [DE] Germany ..... 44 40 701

[51] Int. Cl.[7] ..... B65D 3/26

[52] U.S. Cl. ..... 229/245; 229/125.15; 220/270; 220/359.2; 53/133.7; 53/135.2; 493/963

[58] Field of Search ..... 220/269, 270, 220/359, 703, 711, 359.1, 359.2, 359.3, 359.4; 215/232; 229/125.14, 123.1, 245, 125.15; 413/12; 53/415, 410, 133.7, 133.3, 135.2; 493/87, 963

[56] References Cited

U.S. PATENT DOCUMENTS

| | | | |
|---|---|---|---|
| 1,767,742 | 6/1930 | Case | 229/125.04 |
| 1,884,545 | 10/1932 | Boutin | 229/125.04 |
| 2,004,818 | 6/1935 | Luckett | 229/125.04 |
| 2,218,670 | 10/1940 | Bennett | 493/87 X |
| 2,249,052 | 7/1941 | Seiffert . | |
| 2,740,547 | 4/1956 | Huntting | 220/359.2 |
| 3,269,586 | 8/1966 | Quimby et al. | 220/269 X |
| 3,536,244 | 10/1970 | Collie | 229/125.04 |
| 3,690,509 | 9/1972 | Kinoian et al. . | |
| 4,223,789 | 9/1980 | Reil | 229/123.1 |
| 4,516,689 | 5/1985 | Barker | 220/269 X |
| 4,582,216 | 4/1986 | Byrd | 220/269 X |
| 4,632,299 | 12/1986 | Holmberg | 229/123.1 |
| 4,715,528 | 12/1987 | Kjelgaard et al. | 229/123.1 |
| 4,771,936 | 9/1988 | Dolby | 229/123.1 |
| 5,094,357 | 3/1992 | McKinney | 220/269 X |
| 5,653,383 | 8/1997 | Adachi et al. | 493/87 X |

FOREIGN PATENT DOCUMENTS

| | | | |
|---|---|---|---|
| 0 165 639 A3 | 12/1985 | European Pat. Off. . | |
| 0 385 954 A1 | 9/1990 | European Pat. Off. . | |
| 540923 | 5/1993 | European Pat. Off. | 229/123.1 |
| 3434002 | 3/1986 | Germany | 220/269 |
| 40 14 774 A1 | 11/1991 | Germany . | |
| PCT/EP88/01203 | 11/1989 | WIPO . | |
| WO 91/00826 | 1/1991 | WIPO . | |

*Primary Examiner*—Stephen K. Cronin
*Assistant Examiner*—Nathan Newhouse
*Attorney, Agent, or Firm*—Evenson McKeown Edwards & Lenahan P.L.L.C.

[57] ABSTRACT

A container has a sleeve-shaped container body part and a front wall. The discharge opening in the front wall is closed by a pull tab which is extended from the container body part for improved hygiene in the discharge area.

2 Claims, 5 Drawing Sheets

CONTAINER COMPRISING A CONTAINER BODY PART AND A FRONT WALL CONNECTED THERETO

CROSS-REFERENCE TO RELATED APPLICATIONS

This application is a continuation of application Ser. No. 08/545,094, filed on Oct. 19, 1995, now abandoned.

BACKGROUND AND SUMMARY OF THE INVENTION

The present invention relates to a container comprising a container body part and a front wall connected thereto. The front wall has a discharging opening which is closed by a pull tab arranged on the outer surface of the front wall and at least partly detachable therefrom. The present invention also relates to a process for applying the aforementioned pull tab to a container discharge opening in a container having a container body part and a front wall connected thereto.

German published patent application 40 14 774 describes a container consisting of a container body part and two front walls connected thereto. A discharge opening is provided in one front wall and also serves as a filling opening. The discharging opening is closed by a pull tab arranged on the outer surface of the front wall and covering a part thereof. The pull tab can be detached from the front wall, thus freeing the discharge opening so that the container contents can be poured out.

The contents of the known container flow out over the lid and the area of the circumferential border of the container body part when poured, and thereby into contact with that part of the surface which was not covered by the pull tab and therefore is not sterile.

It is an object of the present invention to improve the hygienic conditions in the discharging area of containers.

This object has been achieved in accordance with the present invention in that the pull tab is extended in the area of the container body part and is arranged on the outer surface thereof, from which it is at least partly detachable.

This object has been further achieved by a process in which the pull tab is applied to the outer surface of the container body part in such a way that the pull tab is at least partly detachable therefrom.

The extended length of the pull tab in the area of the container body part increases the surface area on the outer side of the container which remains clean after opening. The above mentioned surface area corresponds to the discharge area, that is, the area on the surface of the container over which the container contents flow during pouring out.

Before the pull tab is applied, the surface area covered thereby is in a completely sterile condition. The area is sterilized again if required before the pull tab is applied. This sterile state is maintained up until the pull tab is detached before emptying the container. The container contents are thus not contaminated by impurities or bacteria during emptying.

In an advantageous embodiment, the pull tab is arranged so the drinking area on the container body part and on the front wall is covered. When the consumer drinks from the container, the mouth also comes into contact with a part of the outer sleeve surface. The drinking area is thus larger than the discharge area, over which the container contents flow while, for example, being discharged into a drinking vessel. The pull tab is advantageously arranged on the container so that, when the pull tap is detached, the entire drinking area of the container is uncovered.

The pull tab can be laid down on the outer surface of the container body part and affixed thereto. It is particularly advantageous when the pull tab is made in one piece with the front wall and forms an extension of its surface. Only the part standing out from the front wall and forming the extension of the pull tab need then be affixed to the container body part.

The pull tab can be further arranged on the container such that it is laid down on the outer surface of the front wall and affixed thereto. It is also advantageous when the pull tab is made in one piece with the container body part and forms an extension of its surface. Only the part standing out from the container body part and forming the extension of the pull tab need then be affixed to the front wall.

The attachment of the pull tab can be advantageously achieved with a heat sealing connection. This method is particularly easy and results in a good adhesive connection.

It is hereby possible for those areas to be joined together or, if required, the entire area which is to be covered, to undergo a flame treatment. The sealing properties can thus be improved, regardless of the material used. In addition, a flame treatment can have a positive effect in creating a sterile state in the area to be covered.

In one advantageous embodiment, the front wall is arranged sunk inside the container body part, so that a front edge projecting outwards is formed. The pull tab is guided over the front edge to the outer container body surface of the container body part. This embodiment is particularly practical for drinking from the container.

It is further advantageous to make the front wall and/or the container body part from cardboard or from a laminate with at least one cardboard layer. The arrangement of the pull tab according to the present invention and the resulting improvement in hygienic conditions in the discharging area is particularly practical in containers of this type.

The discharging opening can advantageously also be the filling opening. It is thereby possible to create sterile conditions in the area to be covered directly before the closing of the opening by the pull tab.

The improvement in hygienic conditions in the discharging area of containers can be maintained in a simple way by application of the process according to the present invention. The pull tab is applied to the front wall as well as to the container body part so that when detached, at least a part of the pull tab of the discharging area of the container is uncovered in a sterile state.

Various advantageous processes for applying the pull tab to the container are possible. For example, the pull tab can be applied to the container with a first section before filling, and in a later procedure to fill the container through the discharging opening, which also forms the filling opening. Thereafter the discharging opening is closed by a second section of the pull tab, which second section closes and covers the entire discharging area.

Alternatively, the pull tab can be applied close to the container before filling or after filling. In the former, the discharging opening cannot, however, also serve as a filling opening.

Before completion of the container, a part of the pull tab can also be applied to a component from which the container will be made. That is, before the container is completed, a part of the pull tab is applied to a component from which the container will be made, and thereafter adhered to the container by another part. For example, a first part of the pull tab is applied to the container body part or to a segment from which the container body part will be formed, and in a later production stage another part is affixed to the front wall.

It is also within the scope of the present invention to apply a first part of the pull tab to the front wall or to a segment which will form the front wall, and in a later procedural step to attach the other part to the container body part. The application of the first part of the pull tab occurs in that the pull tab is formed as a separate component and is affixed by the first part to the container body part or to the front wall or to a segment which will form the container body part or the front wall. Application can alternatively occur in that the pull tab is formed integrally with the container body part or with the front wall or with the segment forming either one. In both instances, the other part of the pull tab not yet applied is affixed to the container in a later production stage. It is thus possible when using a machine for the production of containers to feed segments thereto, which segments are already provided with a pull tab, whereby during or after the production of the container the pull tab is affixed thereto. It is also possible, during production, for example during or after formation of the container body part or during or after formation of the lid, to apply the pull tab and, in a later production stage, to create an adhesive connection.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
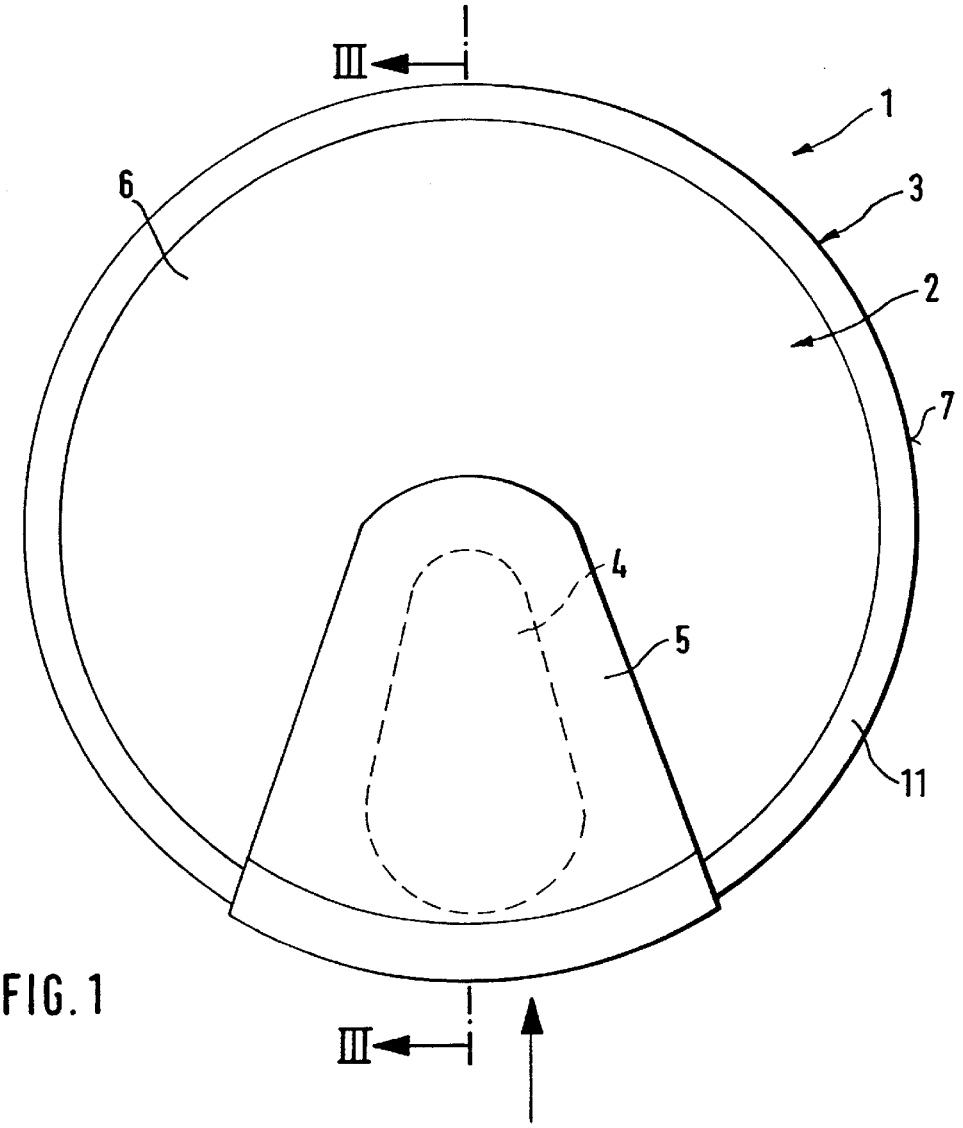
FIG. 1 is a top view of a first embodiment of a container in accordance with the present invention.
Figure 2:
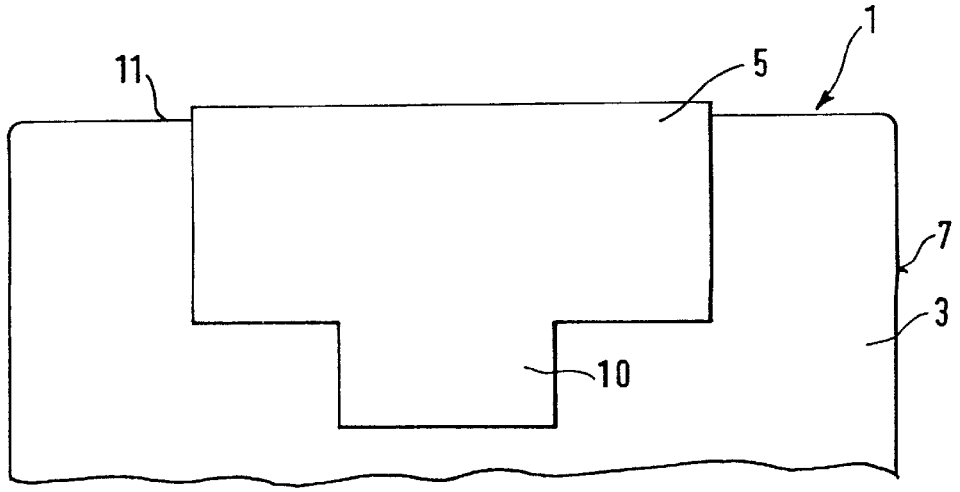
FIG. 2 is a partial view of the container in the direction of Arrow II in FIG. 1.

The container 1 shown in FIGS. 1 to 4 consists of a container body part 3 in the form of a cylindrical sleeve and two front walls which close the front end openings of the container body part 3. One of the front walls 2 forms the lid of the container 1, and the other front wall (not shown) forms the bottom.

Instead of the container 1 shown here comprising a container body part 3 in the form of a cylindrical sleeve and two front walls, another differently shaped container, comprising a container body part and at least one front wall could be used. In other words, the present invention is not limited to the form or shape of the container body part or the front wall.

Both the front walls and the container body part 3 of the container 1 are made of compound material, comprising a carrier layer of cardboard and a plastic layer located on the inside of the completed container 1. The front walls are, as in the case of the container body part 3, provided with an additional plastic layer on the outside. If desired, as a further layer, a metal foil can be provided in the container body part 3 and the two front walls. The plastic layers are preferably so provided that a heat sealing connection can be made therewith. The different layers of the container 1 mentioned above are not shown as they are not necessary for a full understanding of the present invention.

The front wall 2 has a projecting edge in its circumferential area, which edge is directed away from the inside of the container 1. A front end section of the wall of the container body part 3 is flanged around the projecting edge of the front wall 2 towards the inside of the container 1 and affixed in a leakproof way to the front wall 2, preferably by heat sealing. The projecting edge of the front wall 2 and the section of the wall of the container body part 3 surrounding it form together a front edge 11 of the container 1. The plane section of the front wall 2 is arranged sunk slightly in the container body part 3 in the direction towards the inside of the container 1. The other front wall (not shown) of the container 1, which forms the bottom, is arranged in the container 1 in the same way as the front wall 2 which forms the lid as will be understood by one of ordinary skill in this art.

Figure 4:
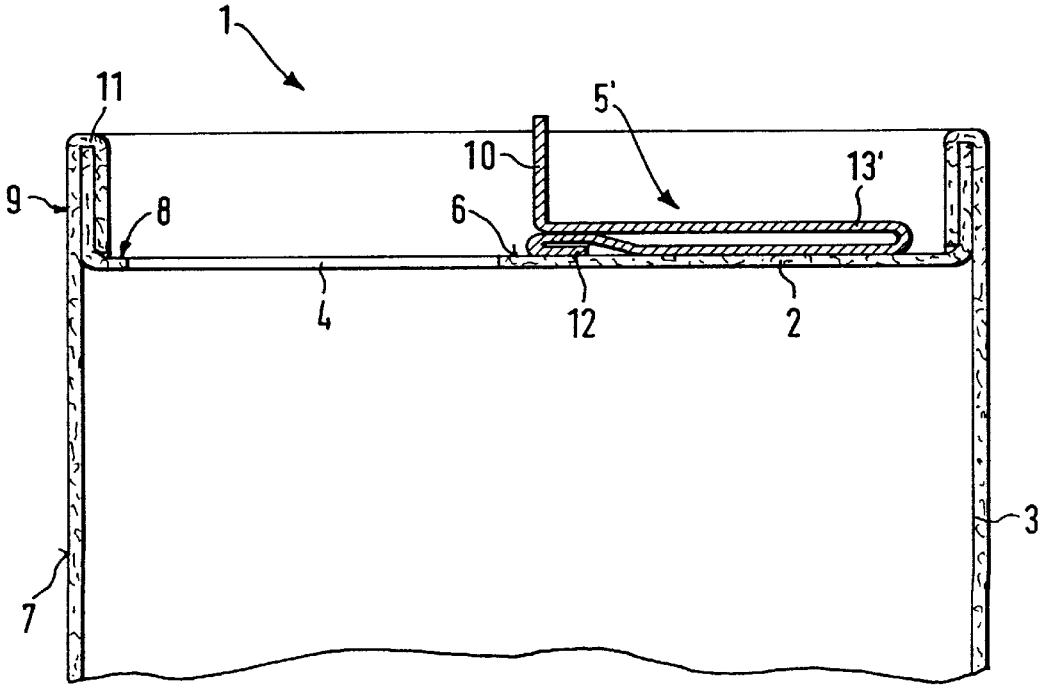
FIG. 4 is a partial view of a longitudinal section of the container in FIG. 1 similar to FIG. 3 but with an open pull tab.

The front wall 2 forming the lid contains a discharging opening 4 which is also used as a filling opening. When the container 1 is full, the discharging opening 4 is covered by a pull tab 5. Before filling, the pull tab 5 takes up the position 5' as shown in FIG. 4.

The pull tab 5 consists of a metal foil, which is provided on the side facing the inside of the container 1 with a plastic layer (not shown). This plastic layer serves the purpose of creating a heat sealing connection with the outer side of the container 1. Another suitable material having the properties necessary for a pull tab could be used instead of the metal foil, for example a compound material with a layer of cardboard and another, or several, layers of plastic.

Before filling, the pull tab 5 is affixed by a first section 12 to the outer surface 6 of the front wall 2. It takes up the position 5' already mentioned and shown in FIG. 4, whereby the discharging opening 4 is not covered. A second section 13 of the pull tab 5, not yet affixed to the front wall 2 before filling, is folded together in a suitable way above the front wall 2 and takes up the position 13'.

A drinking area 8 is formed on the outer surface 6 of the front wall 2, and a drinking area 9 is formed on the outer surface 7 of the container body part 3. The drinking areas 8, 9 are the areas of the surface 6, 7 of the container 1 which are touched or enclosed by the contents and/or the mouth. The drinking area 8 in the front wall 2 and the drinking area 9 in the container body part 3 are uncovered, as is the discharging opening 4, while the pull tab 5 is in position 5' as shown in FIG. 4. That is, the drinking areas 8, 9 are not yet covered by the pull tab 5.

After the container 1 has been filled, the discharging opening 4 is covered by the section 13 of the pull tab 5. The pull tab 5 is extended in the area of the container body part 3 and covers the drinking area 9 of the container body part 3 by way of a part 14 and covers the drinking area 8 of the front wall 2 by way of a part 15. The second section 13 is affixed to the front wall 2 and the container body 3 so that it is watertight, preferably by way of a heat sealing seam.

Filling and sealing of the container 1 can take place in that a container 1 with an open pull tab 5 is fed to a filling station. The section 13, as already mentioned above, is folded together in a suitable way over the front wall 2 and takes up the position 13' at the front end area of the container 1. The pull tab 5 is first affixed to the outer surface 6 of the front wall 2 by its section 12.

In the embodiment of the present invention described here, the pull tab 5 is already affixed to a segment 16 by its section 12. The segment 16 will form the front wall 2. This process will be described in more detail below.

The affixing of the section 12 can take place instead during or after the making of the container 1. Such an embodiment of the present invention is not further described here.

Directly before filling, the inside as well as the outer end area containing the front wall 2 of the container 1 undergo an aseptic cleaning. The inside of the container 1, as well as the drinking areas 8, 9, the edges of the discharging opening 4 and the section 13 of the pull tab 5 are thus sterilized. The contents are filled through the discharging opening 4 into the inside of the container 1.

Directly after filling, the second section 13 of the pull tab 5 moves out of its position 13' (FIG. 4) and over the discharging opening 4 and the drinking areas 8, 9, (FIG. 3) whereby a part of the front edge 11 is covered by the second section 13. The second section 13 is thus sealed in a watertight fashion in this position by heat sealing onto the surface 6 of the front wall 2 and the surface 7 of the container body part 3. The sterile condition of the drinking areas 8, 9 is thereby maintained.

The pull tab 5 has a grip 10 which is not heat sealed to the container body part 3. The pull tab 5 can be torn off by the grip 10 from the surface 7 of the container body part 3 and the surface 6 of the front wall 2. The discharging opening 4 and the drinking areas 8, 9 of the front wall 2 and the container body part 3 are hereby uncovered. The drinking areas 8, 9 are still in the same sterile condition as when the container 1 was closed.

Figure 7:
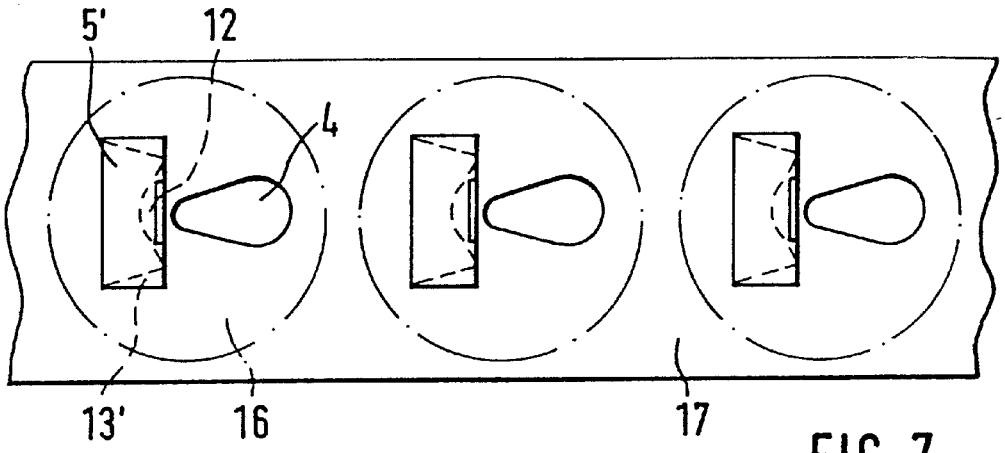
FIG. 7 is a cardboard tape with segments each for lid of a container in accordance with the present invention.

The front wall 2 as shown in FIGS. 1 to 4 can be made in a simple way from a segment 16 as seen in FIG. 7 where a cardboard tape 17 can be fed to a machine for making containers and contains a plurality of such segments 16, as indicated by dot-dash circles. The segments 16 are cut out of the cardboard tape 17 in the above-mentioned conventional machine, and each segment 16 is then formed into a front wall 2, whereby in particular the projecting edge mentioned above is formed in the circumferential area of the segment 16.

The segment 16 is composed of the same layers as the front wall 2 and already comprises all components which make up a finished front wall 2. The discharging opening 4 is already present in the segment 16, which may be provided with a suitable edge protection (not shown). The pull tab 5 is, in addition, already applied to the segment 16 so that the discharging opening 4 is not covered.

In an unillustrated embodiment within the scope of the invention the pull tab can be applied in such a way that the discharging opening is covered. This can be useful when, for example, the discharging opening is not simultaneously the filling opening. The pull tab 5 is situated in an identical or similar folded position 5' in the embodiment shown here to that shown in FIG. 4. The section 12 of the pull tab 5 is fixed on that side of the segment 16 beside the discharging opening 4 which later forms the outer surface of the front wall 2. Section 12 is fixed by known methods, for example by adhering, heat sealing or similar. The pull tab 5, fixed and folded on the segment 16 in the aforementioned way, is already present in this embodiment in the cardboard tape 17 which is fed to the machine for producing containers.

Figure 5:
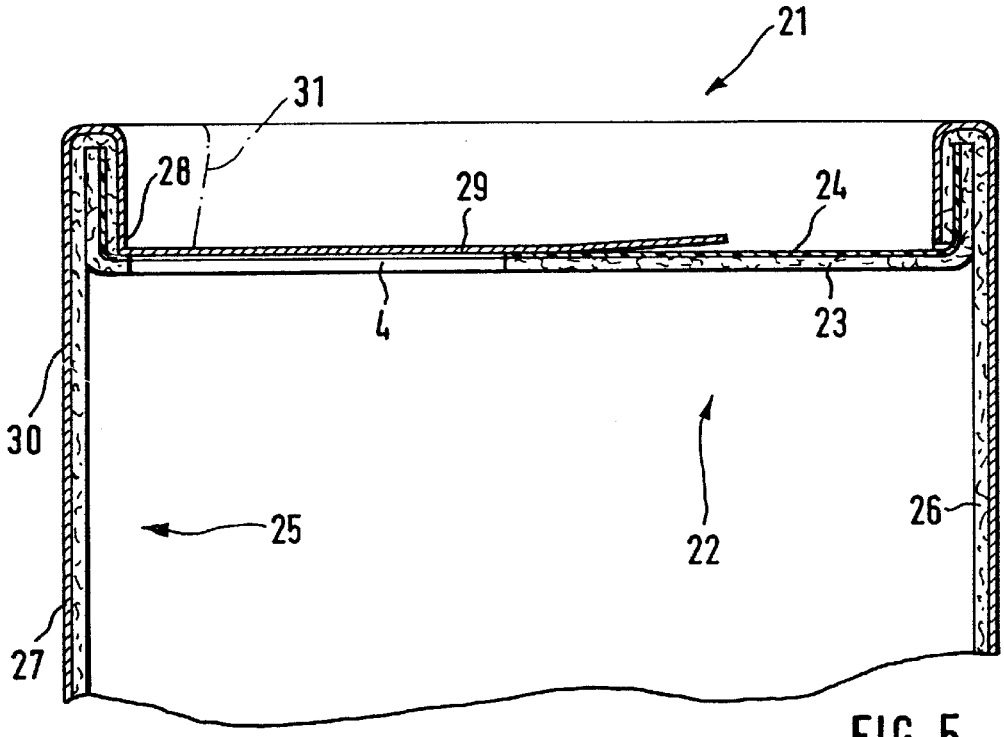
FIG. 5 is a partial view of a longitudinal section similar to FIG. 3 but of a second embodiment of a container.

A second embodiment of a container 21 is shown in FIG. 5. This container 21 is, as is the container 1 of FIGS. 1 to 4, comprised of a sleeve-shaped container body part 25 and two front walls. Again, only the front wall 22 forming the lid needs to be shown.

The front wall 22 comprises a cardboard carrier layer 23 and a plastic foil outer layer 24, the purpose of which is to enable a heat sealing of the front wall 22 and if required, to serve as a barrier layer. The front wall 22 can be additionally provided with further layers, for example a metal foil. These additional layers are not shown. In the area of the discharging opening 4, the carrier layer 23 and the foil 24 are broken through, whereby the cut edge is covered by a protective layer.

The container body part 25 comprises a cardboard carrier layer 26 and, as an outer layer, a metal foil 27. In addition, further layers (not shown) are provided in the container body part 25, preferably made of plastic and which serve as barrier layers and/or enable a heat sealing.

A pull tab 28 is made in one piece with the container body part 25 and forms an extension of the metal foil 27. The pull tab 28 is provided with a heat sealable plastic layer on at least one part 29 which comes to rest on the front wall 22. When the container 21 is closed, the pull tab 28 is fixed, watertight, on the surface of the front wall 22 by a heat sealing connection. The drinking area of the front wall 22 is hereby covered by the part 29 of the pull tab 28. The drinking area of the container body part 25 is located under the foil 27 and is uncovered when the pull tab 28 is removed, and a part 30 of the foil 27 of the container body part 25 is removed with it in the below described process.

Figure 8:
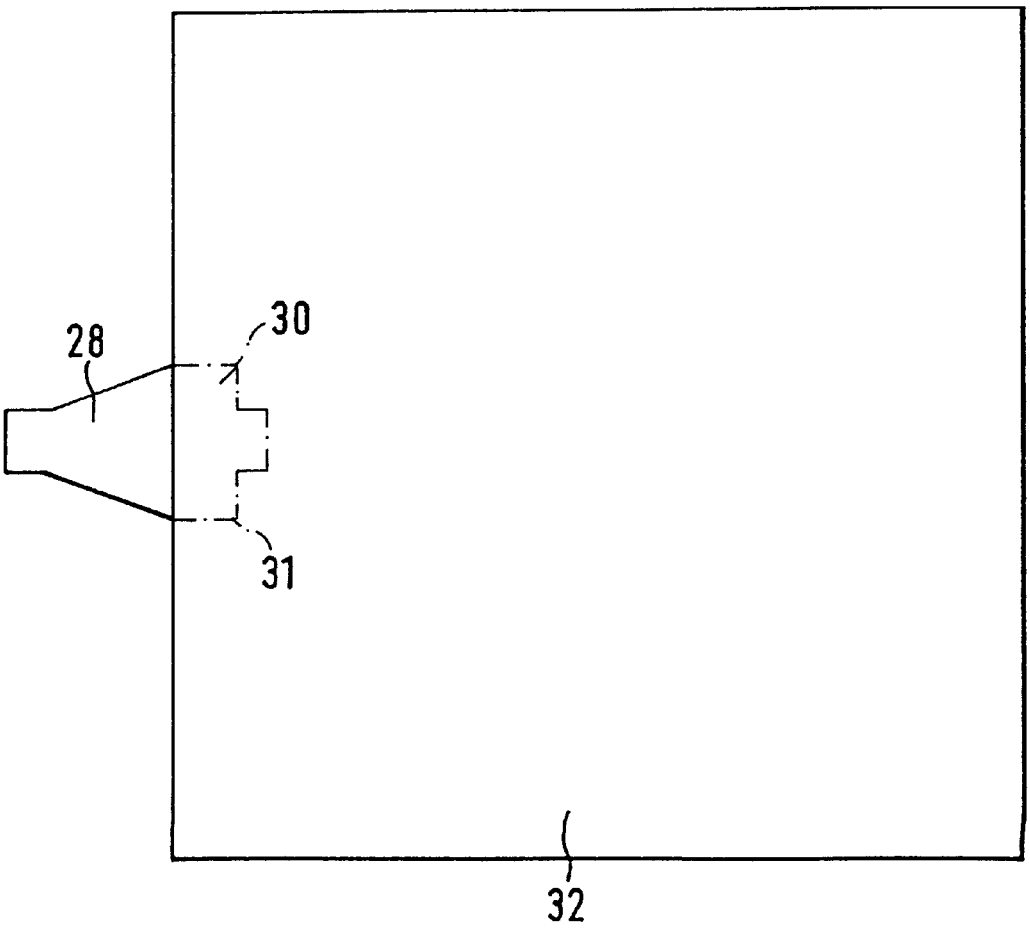
FIG. 8 is a segment for a sleeve of the container in accordance with the present invention.

The container body part 25 with its pull tab-forming extension 28 can be made in a simple way from a segment 32 as seen in FIG. 8. The segment 32, apart from the pull tab 28, is composed of the same layers as the container body part 25. A part 30 of the foil 27 covers what will be the drinking area of the unfinished container body part 25. A part 29 of the pull tab 28 is, as already mentioned above, designated to cover what will be the drinking area in the front wall 22. This part 29 does not comprise a carrier layer 26, but rather consists only of the metal foil 27 and the additional plastic layer mentioned above.

To facilitate the removal of the part 30 of the foil 27 together with the pull tab 28, the foil 27 is provided with a weakened line 31 as seen also in FIG. 5. The weakened line 31 borders what will be the drinking area of the container body part 25.

Figure 3:
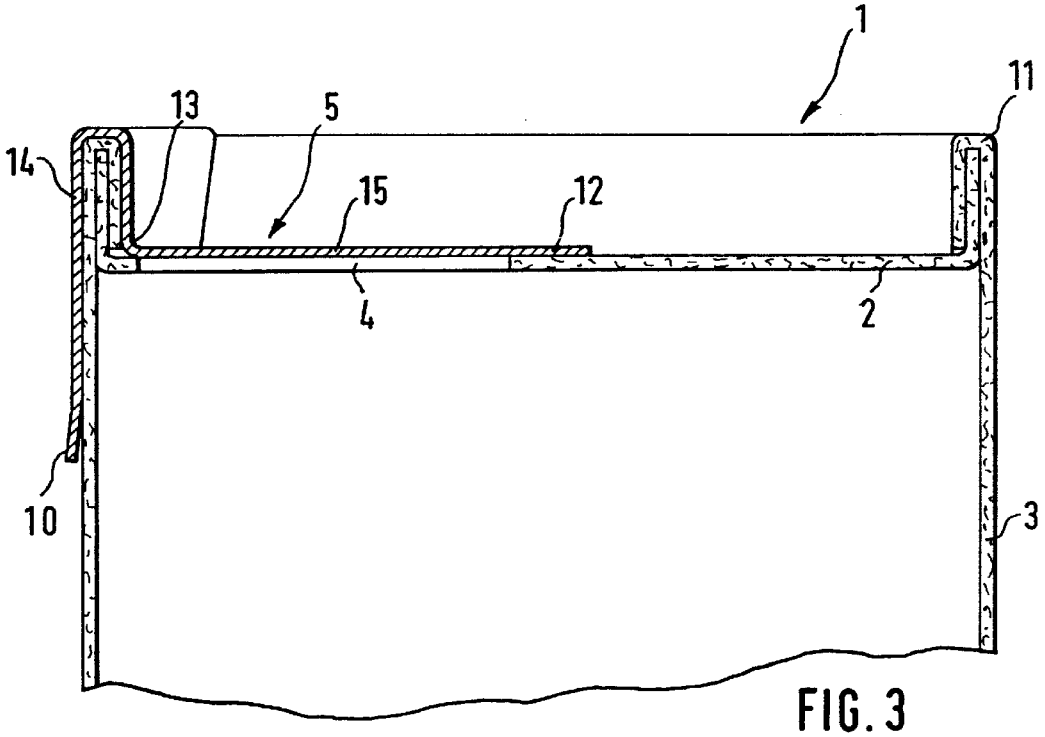
FIG. 3 is a partial view of a longitudinal section of the container in FIG. 1 along the line III—III of FIG. 1.
Figure 9:
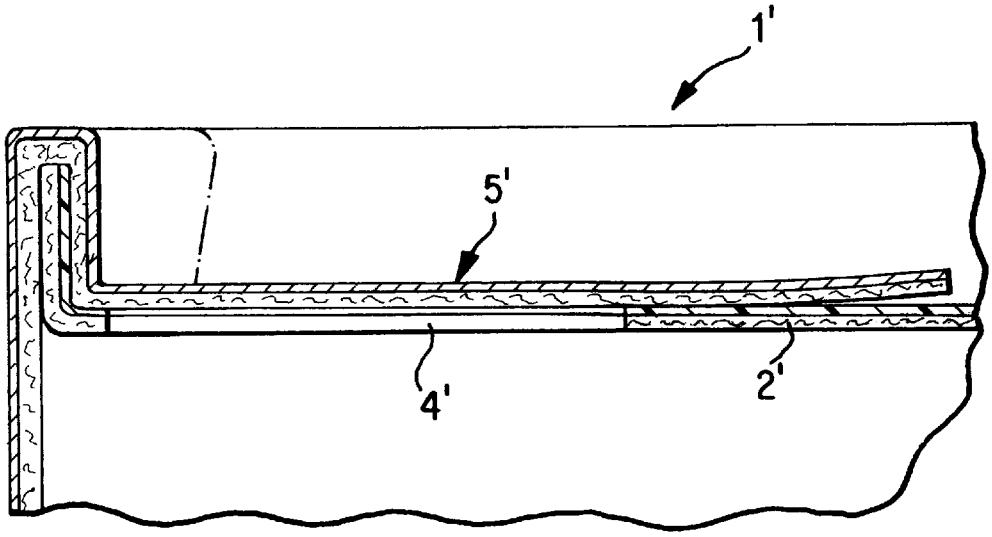
FIG. 9 is a view similar to FIG. 3 but showing an embodiment in which the pull tab is unitary with the container body part.

In another embodiment FIG. 9 in which parts similar to those in FIG. 3 use the same numeral with primes, the pull tab, made integrally with the container body part, is made from the same material as the container body part itself, for example from a compound material with a layer of cardboard and one or a plurality of layers of plastic. In this embodiment, not only one layer of the container body part is extended into a pull tab, but rather all layers of the container body part form the extension which is affixed to the front wall in the form of a pull tab. In such an embodiment it is useful to arrange a weakened line so that the pull tab can, when the discharging opening is opened, be torn from the front wall to the front edge of the container. In the area of the front edge, a predetermined breaking line can be additionally provided, which extends in circumferential direction. The discharging opening can be uncovered without damage to the circumferential side of the container.

For the production of the container 21 shown in FIG. 5, the segment 32 is formed into a sleeve-shaped container body part 25. The part 29 of the pull tab 28 is affixed to the outer surface of the front wall 22 by heat sealing either while or after the front wall 22 is connected to the container body 25. Filling can take place, as already described above in the embodiment of FIGS. 1 to 4 through the discharging opening 4 or instead, if the discharging opening 4 is already closed, through the opening of the container body part 25 for the bottom (not shown), which is not yet closed.

To remove the container contents, the pull tab 28 is removed from the surface of the front wall 22, whereby the heat sealing seam is torn open. The part 30 of the foil 27 can be torn along the weakened line 31, so that the drinking area in the front wall 22 and the container body part 25 is uncovered.

Figure 6:
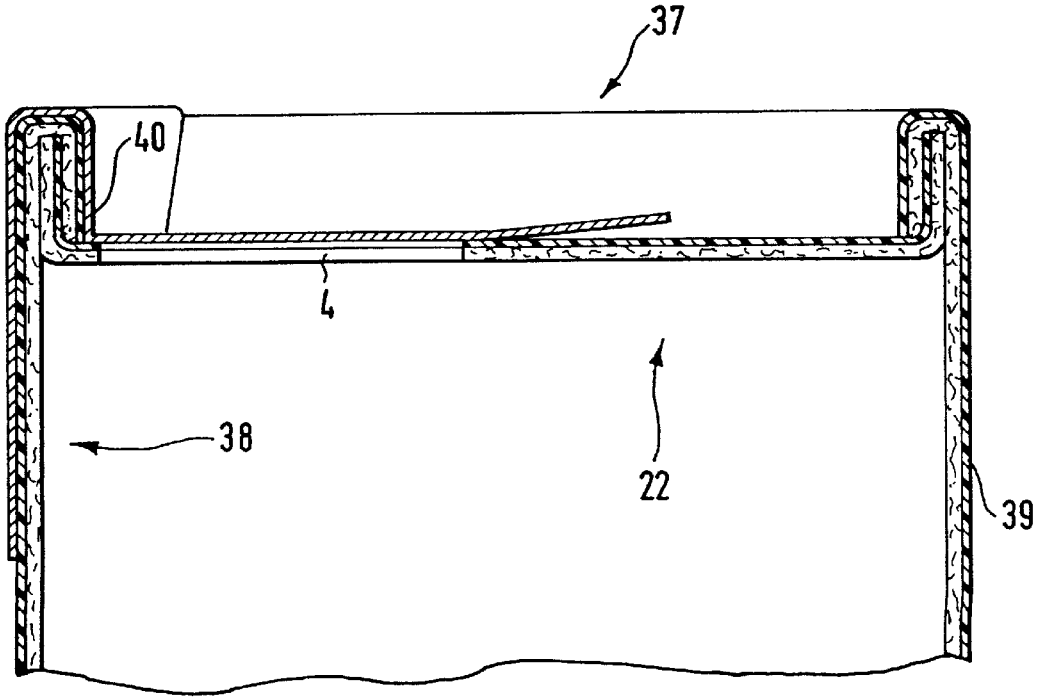
FIG. 6 is a partial view of a longitudinal section similar to FIG. 3 but of a third embodiment of a container.
Figure 10:
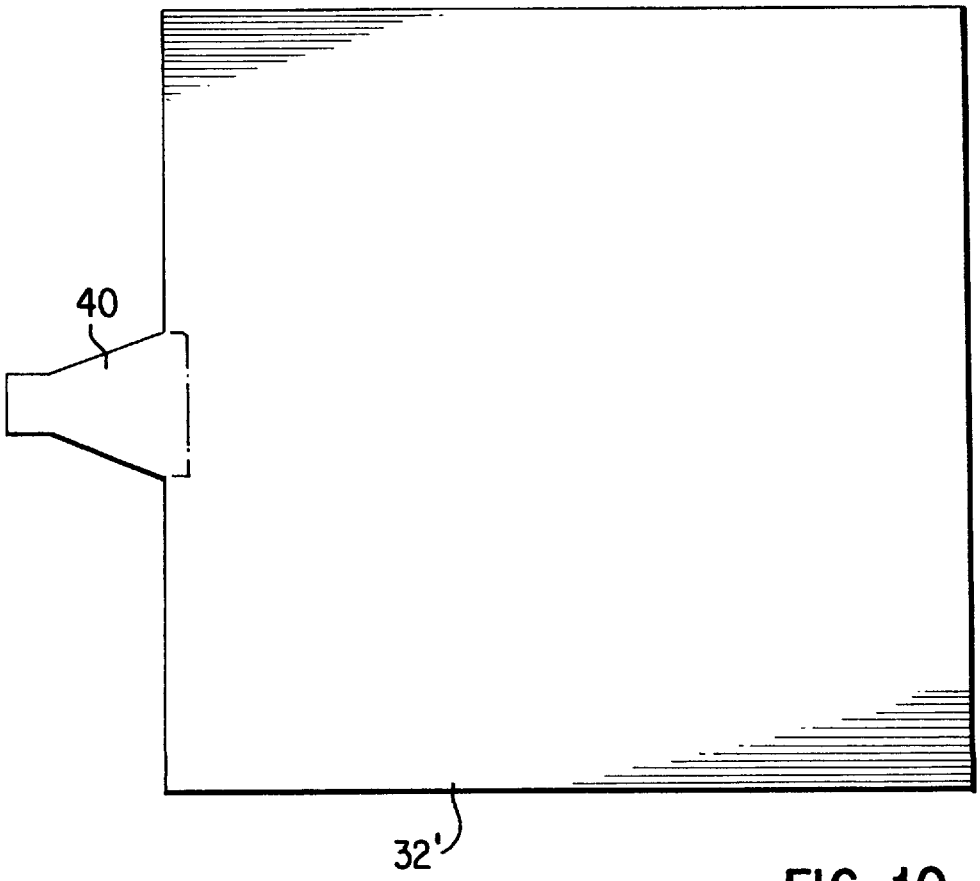
FIG. 10 is a view similar to FIG. 8 but showing an embodiment in which the pull tab is integral or unitary with a segment from which the container body part is thereafter formed.

A third embodiment of a container 37 shown in FIG. 6 is almost identical to the embodiment in FIG. 5. As in the latter, a pull tab 40 is applied to the container body part 38, which can be affixed to the outer surface of a front wall 22 in order to cover the discharging opening 4 as well as the drinking area of the container 37. The pull tab 40 in FIG. 6 is, however, not made in one piece with the container body part 38. It is affixed to an outer plastic layer 39 of the container 37 and can be placed on the outer surface of the front wall 22 from this point and affixed thereto. It is, of course, also possible within the scope of the present invention to attach the pull tab 40 to a segment 32' from which the container body part 38 will be formed as seen in FIG. 10.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drinking container, comprising a container body part, a front wall affixed to the container body part with a sterilizable discharging opening arranged to contact a person's mouth for emptying contents of the container, and an associated pull tab affixed on an outer surface of the front wall for closing the discharging opening in a non-reusable manner and arranged to be at least partially detachable therefrom, the container body part projecting above the front wall to form an upstanding rim and and the pull tab being an extension of the container body part and arranged to be detachable from the rim, wherein the pull tab is detachable from a remainder of the container body part to provide access to the container contents through the discharging opening.

2. The container according to claim 1, wherein the container body part is arranged on each side of the upstanding rim, with means associated with the container body part on a side of the rim for providing detachment of the pull tab from the remainder of the container body part.

* * * * *